US007390196B2

(12) United States Patent
Sasaki

(10) Patent No.: US 7,390,196 B2
(45) Date of Patent: Jun. 24, 2008

(54) CONNECTOR, AND PORTABLE TERMINAL EQUIPMENT INCLUDING THE CONNECTOR

(75) Inventor: Tomoya Sasaki, Kanagawa (JP)

(73) Assignee: Kyocera Elco Corporation, Kanagawa (JP)

( * ) Notice: Subject to any disclaimer, the term of this patent is extended or adjusted under 35 U.S.C. 154(b) by 0 days.

(21) Appl. No.: 11/748,552

(22) Filed: May 15, 2007

(65) Prior Publication Data

US 2007/0264854 A1 Nov. 15, 2007

(30) Foreign Application Priority Data

May 15, 2006 (JP) ..... 2006-134997

(51) Int. Cl.
*H01R 12/00* (2006.01)

(52) U.S. Cl. ..... 439/74

(58) Field of Classification Search ..... 439/74, 439/660, 295, 284, 83, 66, 247, 65, 876, 439/95, 931, 342, 884, 70–71, 733.1

See application file for complete search history.

(56) References Cited

U.S. PATENT DOCUMENTS

| | | | | |
|---|---|---|---|---|
| 5,599,192 | A * | 2/1997 | Olson | 439/65 |
| 6,019,613 | A * | 2/2000 | Kataoka et al. | 439/83 |
| 6,905,345 | B2 * | 6/2005 | Zhang | 439/74 |
| 7,195,495 | B2 * | 3/2007 | Takano et al. | 439/74 |
| 2006/0264074 | A1 * | 11/2006 | Chang et al. | 439/74 |

* cited by examiner

*Primary Examiner*—Edwin A. Leon
(74) *Attorney, Agent, or Firm*—McCormick, Paulding & Huber LLP

(57) ABSTRACT

A connector includes a plug including a plug body made of an insulating material and a plug contact; a receptacle including a receptacle body made of an insulating material and a receptacle contact, wherein the receptacle contact contacts the plug contact to be electrically connected with the plug contact when the plug is inserted into the receptacle; a plug-contact contacting portion formed on the receptacle contact for contacting the plug contact when the plug is inserted into the receptacle; an inner-wall-contacting portion extending from an end of the plug-contact contacting portion toward an inner wall of the receptacle body; and a contacting portion formed on the plug contact extending in a plug insertion/extraction direction. The first contacting portion slides on the plug-contact contacting portion and the inner-wall-contacting portion contacts the inner wall of the receptacle body when the plug is inserted in/extracted from the receptacle.

15 Claims, 3 Drawing Sheets

CONNECTOR, AND PORTABLE TERMINAL EQUIPMENT INCLUDING THE CONNECTOR

CROSS REFERENCE TO RELATED APPLICATION

The present invention is related to and claims priority of the following co-pending application, namely, Japanese Patent Application No. 2006-134997 filed on May 15, 2006.

BACKGROUND OF THE INVENTION

1. Field of the Invention

The present invention relates to a connector including a receptacle and a plug which are engaged with each other to be electrically connected to each other.

2. Description of the Prior Art

In a conventional connector including a receptacle and a plug which are engaged with each other to be electrically connected to each other by inserting the plug into an insertion groove formed in the receptacle, a further reduction in height of the connector is now in increasing demand with the miniaturization of portable terminal equipment or other devices which adopt this type of connector. However, with this height reduction of the connector, the holding force for holding the engagement of the receptacle with the plug tends to decrease, which makes it easy for the receptacle and the plug to be undesirably disengaged from each other.

On this account, a type of connector with a lock mechanism, wherein contacts (terminals) of the receptacle are provided with lock lugs while a plug body (insulating housing) of the plug is provided with corresponding engaging projections engageable with the lock lugs, respectively, has been proposed. This type of connector is disclosed in Japanese Unexamined Patent Publication H09-259979. In this type of connector, the holding force for holding the engagement of the receptacle with the plug is improved by making the lock lugs and the engaging projections engaged with each other, respectively, upon the plug being inserted into the receptacle.

On the other hand, in conjunction with the achievement in height reduction of the connector, a type of connector in which a column projecting from a center of an insulator of the receptacle is provided symmetrically on opposite sides of the column with a pair of movement preventive portions, respectively, to prevent ends of the contacts of the receptacle from being curled up upon the plug being extracted from the receptacle. This type of connector has been proposed in Japanese Unexamined Patent Publication 2001-338711.

However, in the above described connector disclosed in JUPP 2001-338711, in which contacts of the receptacle are provided with lock lugs, the plug body of the plug, on which the engaging projections are formed, wear out over time as the plug is repeatedly inserted into and extracted from the receptacle, which causes the plug body of the plug to produce dust or shavings and further causes the engaging projections to be deformed to thereby lower the holding force for holding the engagement of the receptacle with the plug.

In JUPP 2001-338711, in which the receptacle is provided with the pair of movement preventive portions, the height of the pair of movement preventive portions needs to be reduced if it is desired to achieve a further reduction in height of the connector. However, since this reduction deteriorates the strength of the movement preventive portions, there is a possibility of ends of the contacts of the receptacle not being prevented from being curled up. Additionally, even if this curling can be prevented from occurring, there is a possibility of the contacts which are engaged with the pair of movement preventive portions not returning to their original positions; this type of connector in which the contacts of the receptacle no longer return to the original positions cannot make full use of the capabilities of the connector.

SUMMARY OF THE INVENTION

The present invention provides a connector including a receptacle and a plug which are engaged with each other to be electrically connected to each other, wherein the holding force for holding the engagement of the receptacle with the plug can be prevented from deteriorating even if the plug is repeatedly inserted into and extracted from the receptacle, and shavings and the like can be prevented from being produced by wear in the connector at the same time.

According to an aspect of the present invention, a connector is provided, including a plug including a plug body made of an insulating material and at least one plug contact supported by the plug body; a receptacle including a receptacle body made of an insulating material and at least one receptacle contact supported by the receptacle body, wherein the receptacle contact contacts the plug contact so as to be electrically connected with the plug contact when the plug is inserted into the receptacle; a plug-contact contacting portion formed on the receptacle contact to come in contact with the plug contact when the plug is inserted into the receptacle; an inner-wall-contacting portion which extends from an end of the plug-contact contacting portion toward an inner wall of the receptacle body; and a first contacting portion formed on the plug contact to extend in an insertion/extraction direction of the plug relative to the receptacle. The first contacting portion slides on the plug-contact contacting portion when the plug contact is inserted into and extracted from the receptacle contact. The inner-wall-contacting portion comes in contact with the inner wall of the receptacle body at least when the plug is inserted in and extracted from the receptacle.

It is desirable for the inner-wall-contacting portion to include a bent portion and an end portion extending from the bent portion along the insertion/extraction direction of the plug.

It is desirable for the inner-wall-contacting portion to include a bent portion and an end portion extending from the bent portion in a direction obliquely toward the bottom of the receptacle body while gradually approaching the plug-contact contacting portion.

It is desirable for the inner-wall-contacting portion to include an inclined portion which extends from the end of the plug-contact contacting portion toward the inner wall and toward a bottom of the receptacle body.

It is desirable for the receptacle contact to include a retaining portion for retaining the receptacle contact on the receptacle body; and a connecting portion which connects the retaining portion and the plug-contact contacting portion to each other so that the retaining portion and the plug-contact contacting portion are positioned with a predetermined gap therebetween; and for the plug contact to include a second contacting portion which faces the first contacting portion; and a second connecting portion which has a length corresponding to the gap and connects opposed ends of the first contacting portion and the second contacting portion to each other. The first contacting portion and the second contacting portion slide on the plug-contact contacting portion and the retaining portion, respectively, when the plug contact is inserted into and extracted from the receptacle contact.

It is desirable for the retaining portion to include an outer portion which extends in the insertion/extraction direction of the plug; a central portion which extends to face the outer portion; and a horizontal connecting portion which extends in a direction orthogonal to both directions of extension of the outer portion and the central portion to connect opposed ends of the outer portion and the central portion. The connecting portion of the receptacle contact includes a horizontal connecting portion which extends in a direction parallel to a direction of extension of the second connecting portion, and a first resilient bendable portion which extends from an end of the horizontal connecting portion of the connecting portion of the receptacle contact. The plug-contact contacting portion includes a second resilient bendable portion which is bent to extend back toward the central portion of the retaining portion; a contact projection portion which firstly extends in a direction away from the connecting portion of the receptacle contact from an end of the second resilient bendable portion while approaching the central portion of the retaining portion and subsequently bends in a direction away from the central portion of the retaining portion so as to form a curved projection portion; and a horizontal portion which extends from the contact projection portion in a direction substantially parallel to the direction of extension of the horizontal connecting portion of the connecting portion (50) of the receptacle contact. The central portion and the contact projection portion slide on the second contacting portion and the first contacting portion, respectively, when the plug contact is inserted into and extracted from the receptacle contact.

It is desirable for the first contacting portion to include a projection which projects in a direction away from the second contacting portion, and for the projection to ride over the curved projection portion of the contact projection portion so as to provide a tactile feedback when the plug contact is inserted into the receptacle contact.

It is desirable for the central portion to include a holding projection which projects from the end of the horizontal connecting portion of the connecting portion of the receptacle contact in a direction away from the outer portion, for the second contacting portion to include a projection which projects in a direction away from the first contacting portion, and for the projection of the second contacting portion to rides over the holding projection so as to provide a tactile feedback when the plug contact is inserted into the receptacle contact.

It is desirable for one and the other of the plug and the receptacle to be mounted to a display device unit and a circuit board, respectively, the display device unit and the circuit board being electrically connected to each other via an insertion of the plug into an insertion groove formed on the receptacle.

It is desirable for one and the other of the plug and the receptacle to be mounted to an image pickup device unit and a circuit board, respectively, the image pickup device unit and the circuit board being electrically connected to each other by making an insertion of the plug into an insertion groove formed on the receptacle.

It is desirable for the connector to be incorporated in portable terminal equipment.

It is desirable for the inner-wall-contacting portion to include an inclined portion which extends from the end of the plug-contact contacting portion toward the inner wall and toward the bottom of the receptacle body; an end portion which extends from the inclined portion toward the bottom of the receptacle body; and a bent portion formed between the inclined portion and the end portion.

It is desirable for the retaining portion to be shaped so that a wall of the receptacle body interposes the retaining portion.

It is desirable for the first contacting portion, the second contacting portion and the connecting portion of the plug contact to be configured as a U-shape.

It is desirable for the second resilient bendable portion, the contact projection portion and the horizontal portion of the plug-contact contacting portion to be configured as an S-shape.

It is desirable for the curved projection portion and the holding projection to project in directions toward each other.

The connector according to the present invention is provided with an inner-wall-contacting portion which extends from an end of the plug-contact contacting portion toward the bottom of the receptacle body.

The inner-wall-contacting portion is in contact with the inner wall of the receptacle body while being resiliently deformed, and accordingly, a high holding force for holding the engagement of the receptacle with the plug is achieved even if a further reduction in height of the connector is made because friction resistance is produced between the inner-wall-contacting portion and the inner wall of the receptacle body while the pressure exerted on the plug contact by the receptacle contact can be increased.

In addition, without using elements such as the movement preventive portions disclosed in JUPP 2001-338711, a height reduction of the connector is achieved, and the receptacle contact can be prevented from being curled up regardless of the position of the plug relative to the receptacle upon the plug being extracted from the receptacle.

Additionally, when the plug is inserted into and extracted from the receptacle in a state where the plug and the receptacle are inclined to each other by an angle exceeding a predetermined angle and when the connector is handled, either the position of the inner-wall contact portion or the receptacle contact does not change excessively even if a load greater than expected is exerted on the connector because the inner-wall-contacting portion is in contact with the inner wall of the receptacle body, so that a plastic deformation of the receptacle contact can be prevented from occurring. Consequently, the performance of the connector can be maintained with reliability.

BRIEF DESCRIPTION OF THE DRAWINGS

The present invention will be discussed below in detail with reference to the accompanying drawings, in which.

DESCRIPTION OF THE PREFERRED EMBODIMENT

An embodiment of a connector according to the present invention is provided with a receptacle 1 (shown in FIG. 1) and an associated plug 2 (shown in FIG. 3) which are engaged with each other to be electrically connected to each other. For instance, one of the receptacle 1 and the plug 2 is mounted to an LCD (liquid display device/ display device) unit or a CCD (charge coupled device/ image pickup device) unit, while the other of the receptacle 1 and the plug 2 is mounted to a board (e.g., circuit board) which is electrically connected to the LCD unit or the CCD unit to control operations thereof. The LCD unit or the CCD unit is electrically connected to the board by the engagement of the plug 2 with the receptacle 1. The receptacle 1 and the plug 2 can be adopted for establishing electrical connection within portable terminal equipment (e.g., a cellular phone, a PDA (personal digital assistant) such as a mobile computer and the like) or electrical connection between portable terminal equipment and external equipment. In addition to an LCD unit, the receptacle 1 and the plug 2 can be adopted for use in the following display units: a CRT (cathode-ray tube) display unit, a plasma display unit and an organic EL (electroluminescent) display unit. Moreover, in addition to a CCD unit, the receptacle 1 and the plug 2 can be adopted for use in a CMOS (complementary metal oxide semiconductor) unit.

Figure 1:
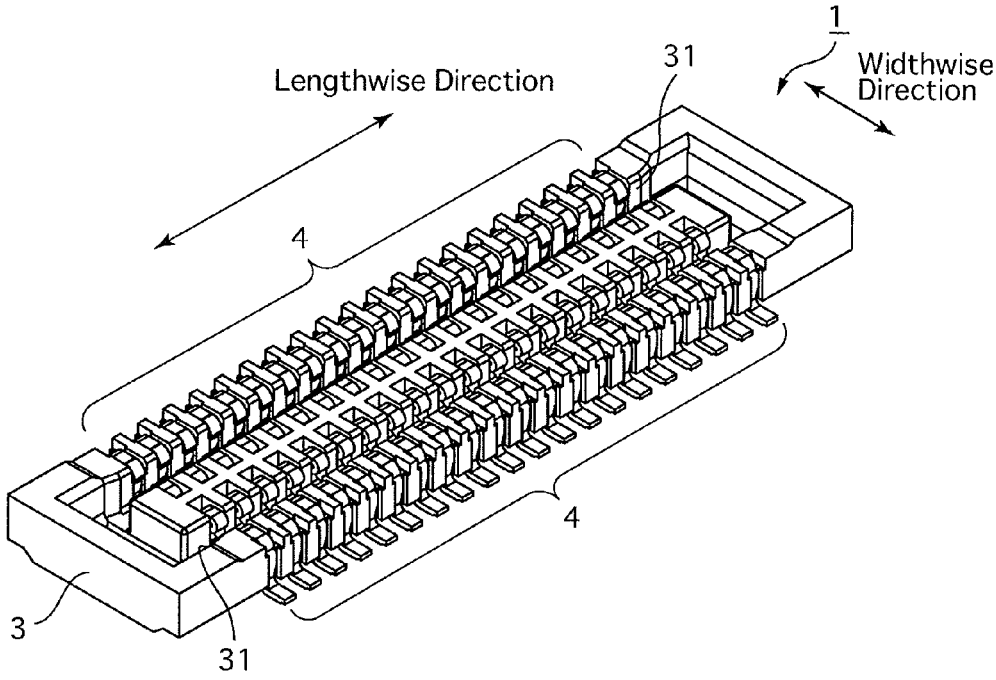
FIG. 1 is a perspective view of a receptacle which serves as an element of an embodiment of a connector according to the present invention, showing the overall structure of the receptacle.

As shown in FIG. 1, the receptacle 1 is provided with a receptacle body 3 and a plurality of receptacle contacts 4, i.e., two arrays of receptacle contacts 4. The receptacle body 3 is molded from an electrical-insulating synthetic resin, e.g., 9T Nylon (trademark), a modified nylon or a liquid crystal polymer by injection molding, and is provided with an insertion groove 31, into and from which the plug 2 is plugged and unplugged. The insertion groove 31 is provided with a bottom wall 32, a side wall 31*a* and an inner wall 35 (see FIGS. 5A and 5B). The two arrays of receptacle contacts 4 are arranged on opposite sides of the insertion groove 31.

Figure 2:
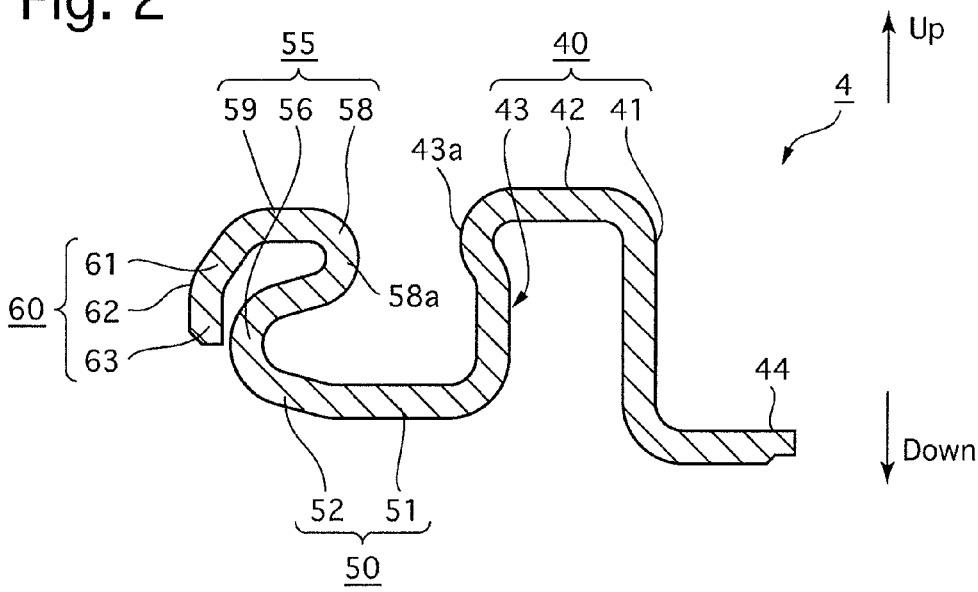
FIG. 2 is a cross sectional view of a receptacle contact of the receptacle shown in FIG. 1, showing the configuration thereof.

As shown in FIG. 2, each receptacle contact 4 is molded of metal by stamping so as to be formed in a strip shape, and is provided with a retaining portion 40, a connecting portion 50, a plug-contact contacting portion 55 and an inner-wall-contacting portion 60 which are continuously formed as an integral member. In the following description, the side on which the plug 2 is positioned and another side on which the receptacle 1 is positioned when the plug 2 is inserted into the receptacle 1 are referred to as the upper side and the lower side (the upper side and the lower side as viewed in FIG. 2), respectively.

The retaining portion 40 is U-shaped and is held by the receptacle body 3 in a manner so that the side wall 31*a* (see FIGS. 5A and 5B) of the insertion groove 31 interposes the retaining portion 40. The connecting portion 50 extends in the widthwise direction of the receptacle 1 (i.e., a direction orthogonal to the lengthwise direction of the insertion groove 31) from one end of the retaining portion 40 which is positioned inside the insertion groove 31. The plug-contact contacting portion 55 is formed as an S-shape in which the receptacle contact 4 firstly bends upward from one end (the left end as viewed in FIG. 2) of the connecting portion 50, subsequently bends back toward a central portion 43 of the retaining portion 40 and thereafter bends in a direction away from the central portion 43.

The retaining portion 40 consists of an outer portion 41, the central portion 43 and a horizontal connecting portion 42. The outer portion 41 extends in the insertion/extraction direction of the plug 2 (which includes both the direction to insert the plug 2 into the insertion groove 31 and the direction to extract the plug 2 from the insertion groove 31). The central portion 43 extends in substantially the same direction as the outer portion 41 to face the outer portion 41. The horizontal connecting portion 42 extends in a direction orthogonal to both the directions of extension of the outer portion 41 and the central portion 43 to connect upper ends of the outer portion 41 and the central portion 43 which are opposed to each other. Each receptacle contact 4 is provided with a terminal portion 44 which is formed integral with the receptacle contact 4 to project outward (rightward as viewed in FIG. 2) from the lower end of the outer portion 41 that is positioned outside of the insertion groove 31 and to project from the bottom end of a side face of the receptacle 3 which extends in the lengthwise direction of the receptacle 3. The terminal portion 44 can be fixed to a conductive pattern formed on a circuit board by, e.g., soldering.

It is desirable that at least one of the outer portion 41 and the central portion 43 of each receptacle contact 4 be provided, at a substantially center thereof in the insertion/extraction direction of the plug 2, with lock lugs (not shown) which project in the opposite directions away from each other along the widthwise direction of the receptacle contact 4, respectively. Such lock lugs are engaged with corresponding engaging portions (not shown) formed on the receptacle body 3 upon the plug contact 4 being mounted to the receptacle body 3. With this structure, the receptacle contact 4 is securely fixed to the receptacle body 3.

In the present embodiment, the receptacle contacts 4 are extremely thin (e.g., 0.1 mm or less), and all the receptacle contacts 4 have a uniform thickness.

However, the following alternative structure is possible. Namely, the central portion 43 can be provided, in an area thereof extending from the end of the central portion 43 on the horizontal connecting portion 42 side to a substantially center of the central portion 43 in the insertion/extraction direction of the plug 2, with a holding projection 43*a* which projects in a direction away from the outer portion 41. The holding projection 43*a* can be press-formed at a lower half of the central portion 43 (which is identical in thickness to the terminal portion 44, the outer portion 41 and the horizontal connecting portion 42) from a substantially center of the central portion 43 in the insertion/extraction direction of the plug 2 so as to reduce the thickness of the holding projection 43*a*. In addition, the dimensions of the holding projection 43*a* and the installation position thereof in the insertion/extraction direction of the plug 2 can be adjusted by stamping the holding projection 43*a* from the back (the surface on the outer portion 41 side) using a die. The thin portion having been made thin by the aforementioned press-forming process is identical in thickness to the connecting portion 50 and the plug-contact contacting portion 55. This kind of thickness distribution strengthens the fixing of the retaining portion 40 and the terminal portion 44 relative to the receptacle body 3 and effectively disperses the stress which is transmitted to the receptacle contact 4 by displacements (deformation) thereof when the plug 2 is inserted into and removed from the receptacle body 3 to thereby prevent a plastic deformation of the receptacle contact 4 from occurring. Accordingly, when each receptacle contact 4 is installed to the receptacle body 3, the outer portion 41 and the horizontal connecting portion 42 can be prevented from being deformed. Moreover, stress becomes harder to be transmitted to the terminal portion 44, and accordingly, the receptacle body 3 and solder for use in joining metallic surfaces can be prevented from becoming cracked when the terminal portion 44 is fixed to the receptacle body 3 and when the terminal portion 44 is fixed to a conductive pattern formed on a circuit board by soldering.

The connecting portion 50 consists of a horizontal connecting portion 51 and a first resilient bendable portion 52. The horizontal connecting portion 51 extends in a direction parallel to the direction of extension of the horizontal connecting portion 42 that extends from the upper end of the central portion 43 of the retaining portion 40. The first resilient bendable portion 52 extends from the left end (as viewed in FIG. 2) of the horizontal connecting portion 51 obliquely upward in a direction gradually away from a horizontal plane in which the horizontal connecting portion 51 lies. It is possible that the horizontal connecting portion 51 and the first resilient bendable portion 52 be integrally formed as a single curved portion which extends obliquely upward in a direction gradually away from a horizontal plane in which the horizontal connecting portion 51 lies.

The plug-contact contacting portion 55 consists of a second resilient bendable portion 56, a contact projection portion 58 and a horizontal portion 59 to be formed in the shape of a substantially letter S as a whole. The second resilient bendable portion 56 is bent to extend back toward the central portion 43 from the inner end (left end as viewed in FIG. 2) of the first resilient bendable portion 52. The contact projection portion 58 firstly extends in a direction away from the connecting portion 50 from the upper end of the second resilient bendable portion 56 while approaching the central portion 43, and is subsequently bent to extend in a direction away from the central portion 43 to thereby form a curved projection portion 58*a*. The horizontal portion 59 extends from the contact projection portion 58 in a direction parallel to the direction of extension of the horizontal connecting portion 51. The first resilient bendable portion 52 and the second resilient bendable portion 56 can be integrally formed in the shape of a single circular arc corresponding to a part of a circle having a constant radius. Forming the plug-contact contacting portion 55 in an S-shape to include a plurality of curved surfaces in this manner makes it possible to form a curved surface with a large radius of curvature, thus making it possible to improve the spring resiliency of the plug-contact contacting portion 55 itself. In addition, connecting the plug-contact contacting portion 55 to the first resilient bendable portion 52 makes it possible for the plug-contact contacting portion 55 to be resiliently deformed in association with the resilient deformation of the connecting portion 50. Therefore, each receptacle contact 4 can make full use of the spring resiliency thereof even in the case of the connector in which space is limited due to a height reduction of the connector.

The inner-wall-contacting portion 60 extends from the inner end (left end as viewed in FIG. 2) of the horizontal portion 59 of the plug-contact contacting portion 55 in a direction away from the retaining portion 40. The inner-wall-contacting portion 60 is provided with an inclined portion 61, an end portion 63, and a bent portion 62 formed between the inclined portion 61 and the end portion 63. The inclined portion 61 extends toward the inner wall 35 of the receptacle body 3 (see FIGS. 5A and 5B) while approaching the bottom wall 32 of the receptacle body 3 in a state where the receptacle contact 4 is held by the receptacle body 3. The end portion 63 extends in a direction substantially parallel to the inner wall 35 of the receptacle body 3 (i.e., along the insertion/extraction direction of the plug 2) from the bent portion 62, that is formed at the lower end of the inclined portion 61, to face the inner wall 35. The end portion 63 can extend in a direction not parallel to the inner wall 35, e.g., can extend from the bent portion 62 in a direction obliquely toward the bottom wall 32 of the receptacle body 3 while gradually approaching the plug-contact contacting portion 55.

Each receptacle contact 4 is made of a base material (e.g., beryllium copper, titanium copper, phosphor bronze or Corson (Ni—Si) copper alloy) on which firstly a base coating (e.g., nickel coating) is plated and subsequently a finishing coating (e.g., gold coating) is plated. In the case where each array of receptacle contacts 4 (each array of plug contacts 7 shown in FIG. 3) are arranged with a pitch of 0.3 mm through 0.5 mm, it is desirable that the thickness of each of the retaining portion 40, the terminal portion 44 and the holding projection 43*a* be in the range of 0.08 mm through 0.15 mm and that the thickness of each of the portion of the central portion 43 (other than the holding projection 43*a*), the connecting portion 50, the plug-contact contacting portion 55 and the inner-wall-contacting portion 60 be in the range of 0.05 mm through 0.08 mm from the viewpoint of spring design and workability in consideration of miniaturization of the connector and the reduction of the height thereof. In this particular case, it is desirable that the thickness of the base coating be in the range of 0.5 through 4.0 micrometers. This range is determined due to the fact that the effectiveness of the base coating becomes invalid if the thickness of the base coating is below 0.5 micrometers and that the base coating becomes cracked easily by a deformation thereof when the base coating is in sliding contact with the associated plug contact 6 of the plug 2 if the thickness of the base coating exceeds 4.0 micrometers. In addition, in the case where the finishing coating is gold, it is desirable that the thickness of the finishing coating of each of the retaining portion 40, the connecting portion 50, the plug-contact contacting portion 55 and the inner-wall-contacting portion 60 be in the range of 0.03 mm through 0.5 micrometers and that the thickness of the finishing coating of the terminal portion 44 be in the range of 0.03 mm through 0.2 micrometers. This is determined due to the fact that, if the thickness of the finishing coating of the terminal portion 44 exceeds 0.2 micrometers, solder (e.g., tin-lead, tin-copper, or tin-copper-silver) for use in soldering the terminal portion 44 to a conductive pattern on a circuit board becomes easier to diffuse, which causes the strength of the connection by soldering to deteriorate, thus causing the solder to become cracked easily.

When the receptacle contacts 4 are mounted to the receptacle body 3, each receptacle contact 4 is inserted into the receptacle body 3 from the upper side thereof, and is pressed-fitted into the insertion groove 31 (the side wall 31*a*) formed in the receptacle body 3 whereby each receptacle contact 4 is held. This fixing manner is possible because each receptacle contact 4 does not have to be inserted into the receptacle body 3 from the lower side thereof since a high holding force for holding the engagement of the receptacle 1 with the plug 2 is achieved by the formation of the inner-wall-contacting portion 60. Accordingly, the receptacle body 3 does not have to be provided in the bottom wall 32 thereof, on which the two arrays of receptacle contacts 4 are to be mounted, with two corresponding arrays of through holes in which the two arrays of receptacle contacts 4 are inserted, respectively.

Moreover, although through holes are made in the bottom wall of the receptacle body due to limiting factors of the molding dies used for molding the pair of movement preventive portions in the connector disclosed in the aforementioned Japanese Unexamined Patent Publication 2001-338711, the receptacle body 3 can be molded without making any through holes in the bottom wall 32 because there is no need for the receptacle body 3 to be provided with movement preventive portions corresponding to those formed on the receptacle body disclosed in Japanese Unexamined Patent Publication 2001-338711.

Therefore, in the present embodiment of the connector, the conductive-pattern-formation impermissible area (in which formation of conductive patterns is not permitted) on a circuit board to which the receptacle body 3 is mounted can be reduced while intrusion of flux and other foreign particles in the receptacle body 3 can be prevented since no through holes are formed in the bottom wall 32 of the receptacle body 3.

The bottom wall 32 (see FIGS. 5A and 5B) of the receptacle body 3, which is positioned below the horizontal connecting portion 51 and the first resilient bendable portion 52 of each receptacle contact 4 when the receptacle contact 4 is fixed to the receptacle body 3, is positioned with a predetermined slight gap between the bottom wall 32 and the horizontal connecting portion 51 in a state where the plug 2 is not engaged in the receptacle 1. It is desirable that this gap be in the range of 0.01 through 0.05 mm. Note that this gap is not shown in the drawings. Products beyond tolerance are produced (i.e., the bottom wall 32 and the horizontal connecting portion 51 are in contact with each other in one connector and not in contact with each other in another connector) due to manufacturing variations if the gap is set below 0.01 mm, and the behavior of each receptacle contact 4 as a spring becomes unstable to thereby make it impossible to obtain a predetermined contact pressure if the gap exceeds 0.05 mm.

Upon each plug contact 7 being engaged in the associated receptacle contact 4, at least the horizontal connecting portion 51, from among the horizontal connecting portion 51 and the first resilient bendable portion 52, comes into contact with the bottom wall 32, which stabilizes the behavior of the receptacle contact 4. Namely, since the variation of the shape of the receptacle contact 4 is limited by the bottom wall 32, plastic deformation of the receptacle contact 4 can be prevented from occurring. In addition, wiring can be carried out even below the receptacle 1 because the insulating bottom wall 32 is positioned below the two arrays of receptacle contacts 4.

Figure 3:
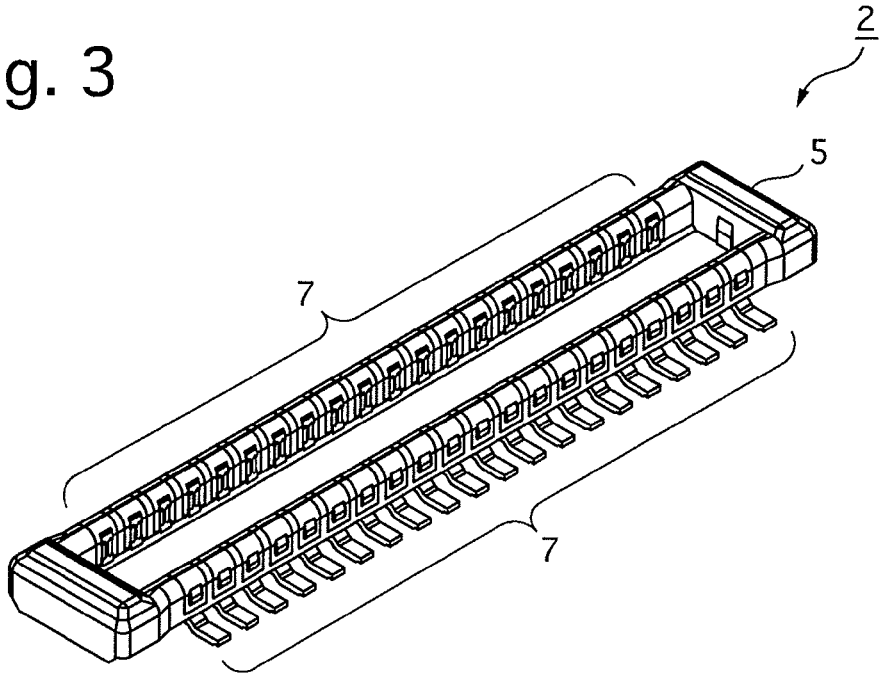
FIG. 3 is a perspective view of a plug which serves as an element of the embodiment of the connector according to the present invention, showing the overall structure of the plug.

The plug 2 that is shown in FIG. 3 is provided with a plug body 5 formed in the shape of a substantially rectangular parallelepiped, and a plurality of plug contacts 7, specifically, two arrays of plug contacts 7 which are arranged to correspond to the two arrays of receptacle contacts 4. The plug body 5 is molded of an electrical-insulating synthetic resin by insert molding, and each array of plug contacts 7 is arranged with the same pitch as the associated array of receptacle contacts 4. The plug body 5 is an insulating member molded integrally with the two arrays of plug contacts 7 from, e.g., 9T Nylon (trademark), amodified nylon or a liquid crystal polymer by insertion molding.

Figure 4:
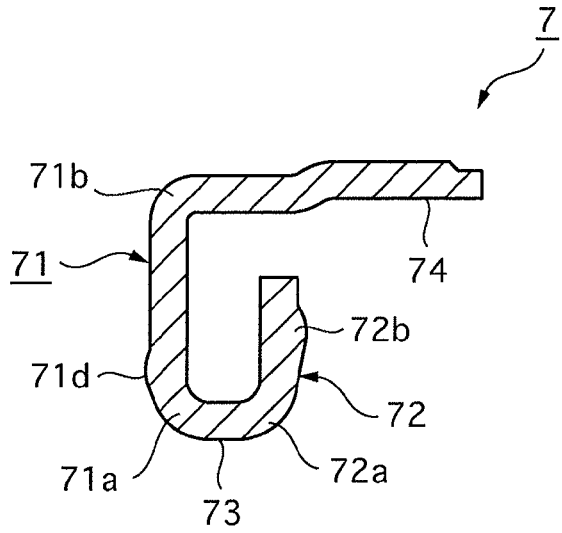
FIG. 4 is a cross sectional view of a plug contact of the plug shown in FIG. 3, showing the configuration thereof.

As shown in FIG. 4, each plug contact 7 is molded of metal by stamping so as to be formed in a strip shape, and is provided with a first contacting portion 71, a second contacting portion 72 and a connecting portion 73 which are continuously formed as an integral member. The first contacting portion 71 extends in the insertion/extraction direction of the plug 2. The second contacting portion 72 extends in substantially the same direction as the first contacting portion 71 to face the first contacting portion 71. The connecting portion 73 extends in a direction orthogonal to both the directions of extension of the first contacting portion 71 and the second contacting portion 72 to connect the lower end 71*a* of the first contacting portion 71 and the lower end 72*a* of the second contacting portion 72 to each other. A terminal portion 74 is formed integral with each plug contact 7, projects from the upper end 71*b* of the first contacting portion 71 and penetrates the plug body 5 to extend in a direction substantially parallel to the connecting portion 73. The terminal portion 74 can be fixed to a conductive pattern formed on a circuit board by, e.g., soldering. Note that the two arrays of plug contacts 7 can be made of the same material as the two arrays of receptacle contacts 4 in a similar manner, hence, the method of forming the two arrays of plug contacts 7 will be omitted from the following description.

The first contacting portion 71 is provided, at the lower end 71*a* thereof on the connecting portion 73 side, with a projection 71*d* which projects in a direction away from the second contacting portion 72. With this configuration of the first contacting portion 71, a tactile feedback can be felt due to the projection 71*d* riding over the curved projection portion 58*a* upon the plug 2 being inserted into the receptacle 1, and the holding of each plug contact 7 to the associated receptacle contact 4 therein is ensured.

On the other hand, the second contacting portion 72 is provided with a projection 72*b* which projects in a direction away from the first contacting portion 71. With this configuration of the second contacting portion 72, a tactile feedback can be felt due to the projection 72*b* riding over the holding projection 43*a* upon the plug 2 being inserted into the receptacle 1, and the holding of each plug contact 7 to the associated receptacle contact 4 therein is ensured. Moreover, each plug contact 7 is in contact with the associated receptacle contact 4 at two points of contact (the point of contact between the second contacting portion 72 and the holding projection 43*a* and the point of contact between the first contacting portion 71 and the curved projection portion 58*a*) to be pinched by the associated receptacle contact 4, and accordingly, reliable electrical connection is established between each plug contact 7 and the associated receptacle contact 4.

Figure 5A:
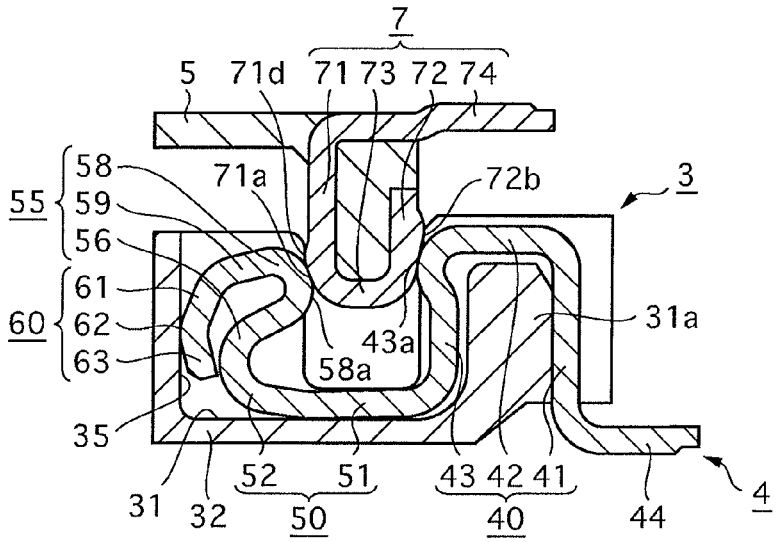
FIG. 5A is a cross sectional view of the receptacle shown in FIG. 1 and the connector shown in FIG. 3 (taken along a plane extending in the insertion/extraction direction of the plug relative to the receptacle), showing a state immediately after the plug commences to be inserted into the receptacle.
Figure 5B:
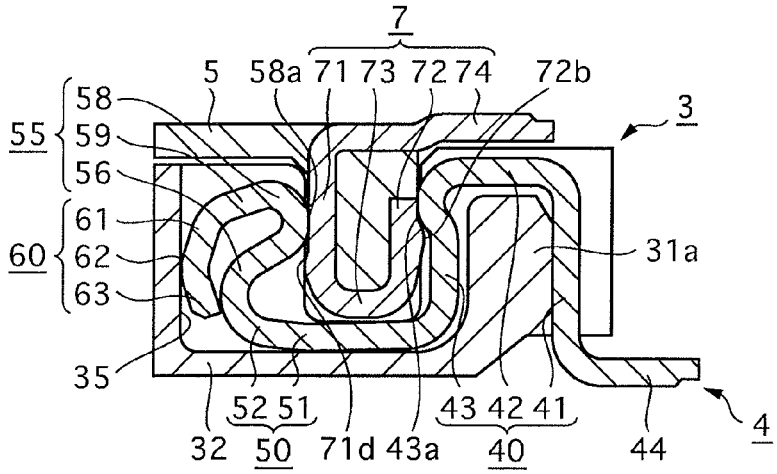
FIG. 5B is a cross sectional view similar to FIG. 5A, showing a state in which the insertion of the plug into the receptacle has been completed.

In the present embodiment of the connector that has the above described structure, in the initial stage in the insertion operation of each plug contact 7 into the associated receptacle contact 4, the lower end 71*a* of the first contacting portion 71 is pressed against an upper portion of the contact projection portion 58, which causes the first resilient bendable portion 52 to approach the bottom wall 32 as shown in FIG. 5A. A further insertion of the plug contact 7 into the receptacle contact 4 causes the inner-wall-contacting portion 60 and the plug-contact contacting portion 55 to be resiliently deformed in the direction of extension of the horizontal connecting portion 51 so as to increase the distance between the holding projection 43*a* and the curved projection portion 58*a*. As a result, the bent portion 62 comes into (firm) contact with the inner wall 35 of the receptacle body 3 that extends in the insertion/extraction direction of the plug 7, and the first contacting portion 71 and the second contacting portion 72 are inserted in between the plug-contact contacting portion 55 and the retaining portion 40 as shown in FIG. 5B while causing the first contacting portion 71 and the second contacting portion 72 to slide on the contact projection portion 58 and the central portion 43, respectively.

In a state where the plug contact 7 is not inserted into the receptacle contact 4, the distance (gap) between the holding projection 43*a* and the curved projection portion 58*a* is constant (predetermined). This predetermined distance is smaller than the distance between the outer surfaces of the first contacting portion 71 and the second contacting portion 72 (the left and right surfaces of the first contacting portion 71 and the second contacting portion 72, respectively, as viewed in FIGS. 5A and 5B). Therefore, upon each plug contact 7 being inserted into the associated receptacle contact 4, the distance between the holding projection 43*a* and the curved projection portion 58*a* of the receptacle contact 4 increases, and the plug contact 7 is held (pinched) by the receptacle contact 4 with the resiliency thereof. The predetermined distance between the holding projection 43*a* and the curved projection portion 58*a* can be set at any given distance according to a design value of the force holding the plug contact 7.

The behavior of each receptacle contact 4 when the plug 2 is inserted into and extracted from the receptacle 1 will be discussed hereinafter.

Firstly, when the plug 2 is inserted into the receptacle 1, the plug-contact contacting portion 55 is compressed from above by the engagement of the first contacting portion 71 with the curved projection portion 58*a*, so that the S-shape of the plug-contact contacting portion 55 is compressed, while the plug contact 7 enters in between the plug-contact contacting portion 55 and the retaining portion 40 while widening the gap between the holding projection 43*a* and the curved projection portion 58*a*, and accordingly, the plug-contact contacting portion 55 shifts toward the inner wall 35 of the receptacle body 3. Since the inner-wall-contacting portion 60 is provided with the inclined portion 61, and since an upper portion of the inner-wall-contacting portion 60 and the inner wall 35 do not come in contact with each other, the plug 2 can be inserted into the receptacle_1 by a relative small force.

The behavior of each receptacle contact 4 when the plug 2 is inserted into and extracted from the receptacle 1 will be discussed hereinafter.

When the plug 2 is extracted from the receptacle 1, each receptacle contact 4 attempts to move with the associated plug contact 7 in a direction to be disengaged therefrom because the plug contact 7 is pinched between the holding projection 43*a* and the curved projection portion 58*a*. Thereupon, the inner-wall-contacting portion 60 slightly rotates in the counterclockwise direction as viewed in FIG. 6 since the friction produced between the plug-contact contacting portion 55 and the first contacting portion 71 creates a torque urging the plug-contact contacting portion 55 to rotate in the counterclockwise direction as viewed in FIG. 6. Accordingly, the inner-wall-contacting portion 60 is in sliding contact with the inner wall 35, which prevents the gap between the holding projection 43*a* and the curved projection portion 58*a* from further widening. Additionally, even if the receptacle contact 4 attempts to be resiliently deformed to widen the gap between the holding projection 43*a* and the curved projection portion 58*a*, the plug contact 7 is securely held by the receptacle contact 4 since the inner-wall-contacting portion 60 is pushed back toward the plug contact 7 by the inner wall 35 by resiliency of the inner-wall-contacting portion 60. Namely, such a configuration makes it possible to achieve a high holding force for holding the engagement of the receptacle 1 with the plug 2. Moreover, this holding force can be adjusted by, e.g., reducing the thickness of the inner-wall-contacting portion 60 by crushing the inner-wall-contacting portion 60. Therefore, when the connector is handled, either the position of the inner-wall-contacting portion 60 or the receptacle contact 4 does not change excessively even if a load greater than expected is exerted on the connector, so that a plastic deformation of the receptacle contact 4 can be prevented from occurring. Consequently, the performance of the connector can be maintained with reliability.

Figure 6:
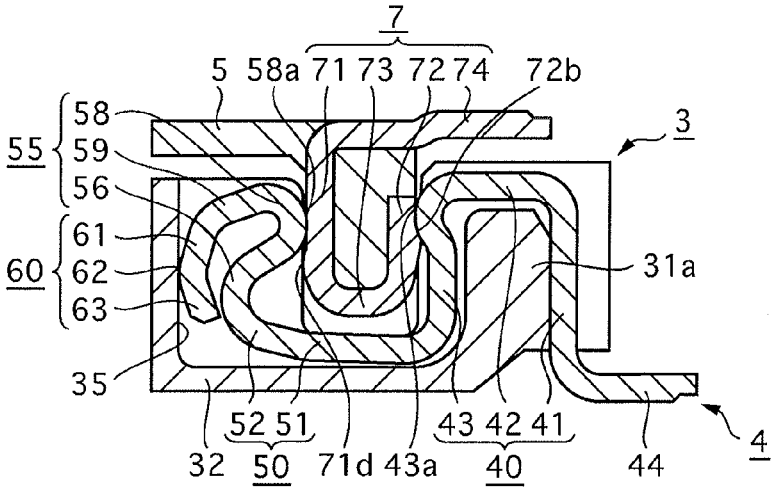
FIG. 6 is a view similar to those of FIGS. 5A and 5B, showing a state immediately after the plug commences to be extracted from the receptacle.

On the other hand, when each plug contact 7 is extracted from the associated receptacle contact 4, an upward sliding movement of the projection 71*d* of the first contacting portion 71 on the curved projection portion 58*a* of the receptacle contact 4 produces a force lifting the plug-contact contacting portion 55 as shown in FIG. 6. Although this force increases in the case where the plug 2 is extracted obliquely from the receptacle 1, the receptacle contact 4 can be prevented from being curled up since the inner-wall-contacting portion 60 is resiliently deformed so that the bent portion 62 thereof is in elastic contact with the inner wall 35 of the receptacle body 3. Upon the extraction of the plug 2 from the receptacle 1 being completed, the gap between the holding projection 43*a* and the curved projection portion 58*a* of each receptacle contact 4 becomes small to return the receptacle contact 4 to a state before the insertion of the plug contact 7 into the receptacle contact 4 by the resiliency thereof.

As can be understood from the foregoing, in the present embodiment of the connector, the holding force for holding the engagement of the receptacle 1 with the plug 2 can be prevented from deteriorating while shavings and the like can be prevented from being produced by wear in the connector even if-the plug is repeatedly inserted into and extracted from the receptacle because the inner-wall-contacting portion 60 is made to contact the inner wall 35 while being resiliently deformed, rather than simply being made to engage with the inner wall 35. In addition, since the connector does not have any elements interfering with a reduction in height of the connector, a further reduction in height of the connector is achieved. Furthermore, when the connector is handled, neither the position of the inner-wall-contacting portion 60 nor the receptacle contact 4 changes excessively even if a load greater than would be expected is exerted on the connector since the inner-wall-contacting portion 60 and the inner wall 35 are in contact with each other, so that an elastic deformation of the receptacle contact 4 can be prevented from occurring, thereby the performance of the connector can be maintained with reliability.

In the above illustrated embodiment of the connector, the functions of each receptacle contact 4 and each plug contact 6 are reversible.

Obvious changes may be made in the specific embodiment of the present invention described herein, such modifications being within the spirit and scope of the invention claimed. It is indicated that all matter contained herein is illustrative and does not limit the scope of the present invention.

What is claimed is:

1. A connector comprising:

a plug including a plug body made of an insulating material and at least one plug contact supported by said plug body;

a receptacle including a receptacle body made of an insulating material and at least one receptacle contact supported by said receptacle body, wherein said receptacle contact contacts said plug contact so as to be electrically connected with said plug contact when said plug is inserted into said receptacle;

a plug-contact contacting portion formed on said receptacle contact to come in contact with said plug contact when said plug is inserted into said receptacle;

an inner-wall-contacting portion which extends from an end of said plug-contact contacting portion toward an inner wall of said receptacle body; and a first contacting portion formed on said plug contact to extend in an insertion/extraction direction of said plug relative to said receptacle, wherein said first contacting portion slides on said plug-contact contacting portion when said plug contact is inserted into and extracted from said receptacle contact;

wherein said inner-wall-contacting portion comprises an inclined portion which extends from said end of said plug-contact contacting portion toward said inner wall and toward a bottom of said receptacle body and comes in contact with said inner wall of said receptacle body at least when said plug is inserted in and extracted from said receptacle;

wherein said receptacle contact comprises:

a retaining portion for retaining said receptacle contact on said receptacle body; and a connecting portion which connects said retaining portion and said plug-contact contacting portion to each other so that said retaining portion and said plug-contact contacting portion are positioned with a predetermined gap therebetween, wherein said plug contact comprises:

a second contacting portion which faces said first contacting portion; and a second connecting portion which has a length corresponding to said gap and connects opposed ends of said first contacting portion and said second contacting portion to each other; and wherein said first contacting portion and said second contacting portion slide on said plug-contact contacting portion and said retaining portion, respectively, when said plug contact is inserted into and extracted from said receptacle contact.

2. The connector according to claim 1, wherein said inner-wall-contacting portion comprises a bent portion and an end portion extending from said bent portion along said insertion/extraction direction of said plug.

3. The connector according to claim 1, wherein said inner-wall-contacting portion comprises a bent portion and an end portion extending from said bent portion in a direction obliquely toward said bottom of said receptacle body while gradually approaching said plug-contact contacting portion.

4. The connector according to claim 1, wherein one and the other of said plug and said receptacle are mounted to a display device unit and a circuit board, respectively, said display device unit and said circuit board being electrically connected to each other via an insertion of said plug into an insertion groove formed on said receptacle.

5. The connector according to claim 1, wherein one and the other of said plug and said receptacle are mounted to an image pickup device unit and a circuit board, respectively, said image pickup device unit and said circuit board being electrically connected to each other by making an insertion of said plug into an insertion groove formed on said receptacle.

6. The connector according to claim 1, wherein said connector is incorporated in portable terminal equipment.

7. The connector according to claim 1, wherein said inner-wall-contacting portion comprises:

an inclined portion which extends from said end of said plug-contact contacting portion toward said inner wall and toward said bottom of said receptacle body;

an end portion which extends from said inclined portion toward said bottom of said receptacle body; and a bent portion formed between said inclined portion and said end portion.

8. The connector according to claim 1, wherein said retaining portion is shaped so that a wall of said receptacle body interposes said retaining portion.

9. The connector according to claim 1, wherein said first contacting portion, said second contacting portion and said connecting portion of said plug contact are configured as a U-shape.

10. The connector according to claim 1, wherein said retaining portion comprises:

an outer portion which extends in said insertion/extraction direction of said plug;

a central portion which extends to face said outer portion; and a horizontal connecting portion which extends in a direction orthogonal to both directions of extension of said outer portion and said central portion to connect opposed ends of said outer portion and said central portion, wherein said connecting portion of said receptacle contact includes a horizontal connecting portion which extends in a direction parallel to a direction of extension of said second connecting portion, and a first resilient bendable portion which extends from an end of said horizontal connecting portion of said connecting portion of said receptacle contact, wherein said plug-contact contacting portion includes a second resilient bendable portion which is bent to extend back toward said central portion of said retaining portion; a contact projection portion which firstly extends in a direction away from said connecting portion of said receptacle contact from an end of said second resilient bendable portion while approaching said central portion of said retaining portion and subsequently bends in a direction away from said central portion of said retaining portion so as to form a curved projection portion; and a horizontal portion which extends from said contact projection portion in a direction substantially parallel to said direction of extension of said horizontal connecting portion of said connecting portion (50) of said receptacle contact, and wherein said central portion and said contact projection portion slide on said second contacting portion and said first contacting portion, respectively, when said plug contact is inserted into and extracted from said receptacle contact.

11. The connector according to claim 10, wherein said second resilient bendable portion, said contact projection portion and said horizontal portion of said plug-contact contacting portion are configured as an S-shape.

12. The connector according to claim 10, wherein said first contacting portion comprises a projection which projects in a direction away from said second contacting portion, and wherein said projection rides over said curved projection portion of said contact projection portion so as to provide a tactile feedback when said plug contact is inserted into said receptacle contact.

13. The connector according to claim 12, wherein said central portion comprises a holding projection which projects from said end of said horizontal connecting portion of said connecting portion of said receptacle contact in a direction away from said outer portion, wherein said second contacting portion comprises a projection which projects in a direction away from said first contacting portion, and wherein said projection of said second contacting portion rides over said holding projection so as to provide a tactile feedback when said plug contact is inserted into said receptacle contact.

14. The connector according to claim 13, wherein said curved projection portion and said holding projection project in directions toward each other.

15. A connector comprising:

a plug including a plug body made of an insulating material and at least one plug contact supported by said plug body;

a receptacle including a receptacle body made of an insulating material and at least one receptacle contact supported by said receptacle body, wherein said receptacle contact contacts said plug contact so as to be electrically connected with said plug contact when said plug is inserted into said receptacle;

a plug-contact contacting portion formed on said receptacle contact to come in contact with said plug contact when said plug is inserted into said receptacle;

an inner-wall-contacting portion which extends from an end of said plug-contact contacting portion toward an inner wall of said receptacle body; and a first contacting portion formed on said plug contact to extend in an insertion/extraction direction of said plug relative to said receptacle, wherein said first contacting portion slides on said plug-contact contacting portion when said plug contact is inserted into and extracted from said receptacle contact;

wherein said inner-wall-contacting portion comes in contact with said inner wall of said receptacle body at least when said plug is inserted in and extracted from said receptacle;

wherein said receptacle contact comprises:

a retaining portion for retaining said receptacle contact on said receptacle body; and a connecting portion which connects said retaining portion and said plug-contact contacting portion to each other so that said retaining portion and said plug-contact contacting portion are positioned with a predetermined gap therebetween, wherein said plug contact comprises:

a second contacting portion which faces said first contacting portion; and a second connecting portion which has a length corresponding to said gap and connects opposed ends of said first contacting portion and said second contacting portion to each other; and wherein said first contacting portion and said second contacting portion slide on said plug-contact contacting portion and said retaining portion, respectively, when said plug contact is inserted into and extracted from said receptacle contact.

* * * * *